United States Patent [19]

Braun et al.

[11] 4,107,931

[45] Aug. 22, 1978

[54] PROGRESSIVE TIMBERING DEVICE

[75] Inventors: Ernst Braun; Gert Braun, both of Essen-Heisingen, Germany

[73] Assignee: Halbach & Braun, Germany

[21] Appl. No.: 814,839

[22] Filed: Jul. 11, 1977

[30] Foreign Application Priority Data

Jul. 28, 1976 [DE] Fed. Rep. of Germany ..... 2633799

[51] Int. Cl.[2] ..... E21D 15/44

[52] U.S. Cl. ..... 61/45 D

[58] Field of Search ..... 61/45 D; 299/31–33; 91/170 MP

[56] References Cited

U.S. PATENT DOCUMENTS

| | | | |
|---|---|---|---|
| 2,826,898 | 3/1958 | Joy | 61/45 D |
| 2,899,800 | 8/1959 | Joy | 61/45 D |

FOREIGN PATENT DOCUMENTS

| | | | |
|---|---|---|---|
| 1,030,282 | 5/1958 | Fed. Rep. of Germany | 61/45 D |
| 1,092,412 | 11/1960 | Fed. Rep. of Germany | 61/45 D |
| 1,139,084 | 11/1962 | Fed. Rep. of Germany | 61/45 D |
| 1,171,859 | 6/1964 | Fed. Rep. of Germany | 61/45 D |

*Primary Examiner*—Dennis L. Taylor

*Attorney, Agent, or Firm*—McGlew and Tuttle

[57] ABSTRACT

A progressive timbering device for use in excavation and mines, comprises a ridge plate adapted to be positioned against the roof or face of the excavation, and a sill disposed beneath the ridge plate adapted to be positioned along the floor. A fluid-pressure operated pressing cylinder and piston combination is disposed between the sill and the ridge plate. Either the ridge plate or the sill, or both, are provided with an endless track guideway extending around the top and bottom and both ends of the associated part, with an endless track engaged in the trackway and projecting outwardly of the associated one of the sills and the ridge plates into engagement with the face of the excavation.

10 Claims, 2 Drawing Figures

PROGRESSIVE TIMBERING DEVICE

FIELD AND BACKGROUND OF THE INVENTION

This invention relates in general to mine excavating and, in particular, to a new and useful progressive timbering device with a moving cylinder, ridge plate and sill, and which includes a pressing cylinder arranged between the sill and the ridge plate.

DESCRIPTION OF THE PRIOR ART

Several forms of execution of progressive timbering are known. In particular, a timbering is known wherein the ridge plate is relieved for the progessing operation, the timbering is then moved forward and, thereafter, the ridge plate is loaded again, i.e., is pressed against the hanging wall.

The problem with such a timbering lies in the load relief of the rock, since hanging wall may break out. In addition, broken out rock lumps are not dropped by the ridge plate, but are pressed into the sound rock again upon its renewed loading, and by this mutilation of the hanging wall, further breaking out is favored in the course of the next progressing operation. In addition, the known timbering is largely direction-bound, i.e., it has almost no ability to take curves to deviate from its progressing direction. Another disadvantage may be seen in that the ridge plate and sill have little self-restraint, so that the known form of timbering is unsuitable for steep places, as a lateral sliding off is to be feared. Lastly, it is a disadvantage when unevennesses occurs because the front end of the roof and sill will no longer run over the hanging wall and the foot wall satisfactorily. Further, these disadvantages are not eliminated by a timbering which, being a sliding extension as it were, does not relieve completely but only to a minimum pressure, and is then dragged forward and loaded again. In this case also, the minimum pressure is not sufficient to prevent a breaking out of the hanging wall.

SUMMARY OF THE INVENTION

The object underlying the invention is to provide a progressive timbering which even in the course of the progressing operation ensures a continuous sufficient loading of the rock and, moreover, excels by special progressing properties in ability to take curves, and has sufficient self-restraint for use in steep positions.

The present invention provides a progressive timbering of the kind in that at least the ridge plate is surrounded by an endless chain mat of endless chains arranged side by side, at least the vertical links of which are guided in progressing direction in guide recesses on the ridge plate.

According to a preferred embodiment of the invention, it is provided that the sill, or the skids forming the sill, is surrounded by a chain mat guided on it in a progressing direction. According to the teaching of the invention, therefore, a mobile timbering is realized, which permits an armor-like progressing with constant maintenance of the complete pressing pressure against the hanging wall. In fact, with the timbering according to the invention, it is unnecessary to relieve the ridge plate in the course of the progressing because the chain mat running around it in progressing direction rolls off on the hanging wall and, in relation to the sill, on the foot wall. This chain mat excels at the same time by the ability to run over unevennesses on the foot wall and the hanging wall and to travel through curves due to its construction with a plurality of endless chains arranged side by side. The chain mat revolving in progressing direction gives the entire timbering extremely easy motion in a progressing direction, whereas, crosswise to the progressing direction, it excels by great self-restraint, because the chain mat presses into the hanging wall and possibly the foot wall. Any rock lumps detached from the hanging wall are dropped by the chain mat surrounding the ridge plate during the progressing and are not pressed into the sound rock again. To this extent, the chain mat operates as a conveyor belt which revolves during the moving operation. The divergence normally present between hanging wall and foot wall in a mining direction supports the driving of the timbering according to the invention with the usual moving cylinders.

Thus, the invention provides that the endless chains are arranged close together side by side, thus forming a closed chain mat. According to the invention, the ridge plate has a run-up arch on the coal face side which may be designed as a boom pivotable up and down and articulated to the ridge plate, although it will suffice if the ridge plate itself is designed with a run-up arch on the coal face side. Such a run-up arch favors the progressing, i.e., the traveling over unevennesses on the hanging wall and possibly on the foot wall because the sill may also have such a run-up arch. According to a further recommendation of the invention, the chain strands of the chain mat running back underneath the ridge plate are guided in superposed arrangement past the pressing ram or similar supporting members, e.g., in guide passages. For this purpose, some endless chains of the chain mat are made longer than the other endless chains.

Satisfactory engagement of the chain mat into the hanging wall and possibly also the foot wall provides functionally safe guiding and easy motion in that the horizontal links of the endless chains forming the chain mat preferably have vertical engaging humps, between which the vertical links are supported on their top side while, on their bottom side, the vertical links are guided in slide grooves in the ridge plate designed as guide recesses and the horizontal links rest on a slide face of the ridge plate. The slide grooves and slide faces are expediently designed as hardened or armored surfaces and, moreover, they may have lubricant supply devices associated with them, for example, a grease brush, spray nozzle or the like.

The advantages achieved by the invention can be seen essentially in that a progressing timbering is realized which surely suppresses a breaking out of the hanging wall in the course of the progressing and dangers connected therewith, as well as molestation by dust, because the timbering is able to travel without relief, so that even in the course of the progressing, it remains pressed against the hanging wall or foot wall, respectively. Moreover, the chain mat running around the ridge plate and possibly the sill provides easy motion in the forward direction, ability to take curves, and lastly, permits the use of the progressive timbering according to the invention even in steep places because of sufficient self-restraint crosswise to the progressing direction. A gliding off of the timber extension is made impossible because of the dovetailing, achieved over the chain mat with the hanging wall or foot wall, as well as by the maintenance of the pressing force against the hanging wall or foot wall. Further, the progressive timbering according to the invention runs over unevennesses without difficulties, and drops any rock lums received by the ridge plate. As a result, the progressive timbering according to the invention excels by its functional construction.

Accordingly, it is an object of the invention to provide a progressive timbering device which comprises a ridge plate with a sill disposed beneath the ridge plate and a fluid-pressure operated pressing cylinder and piston combination disposed between the sill and the ridge plate, and with at least one of the sills and the ridge plates having an endless track, with the guideway extending around the top, bottom and ends thereof and an endless track engaged in the guideway and projecting outwardly of the associated sill and ridge plate.

A further object of the invention is to provide a progressive timbering device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figure 1:
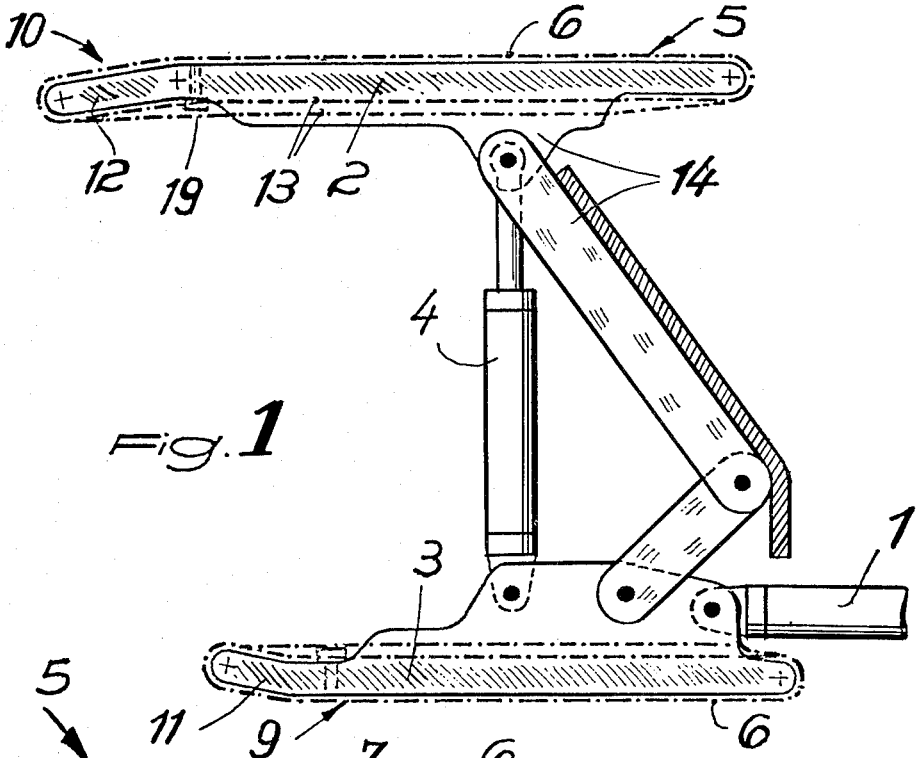
FIG. 1 is a schematic side elevational view of a progressive timbering device constructed in accordance with the invention.
Figure 2:
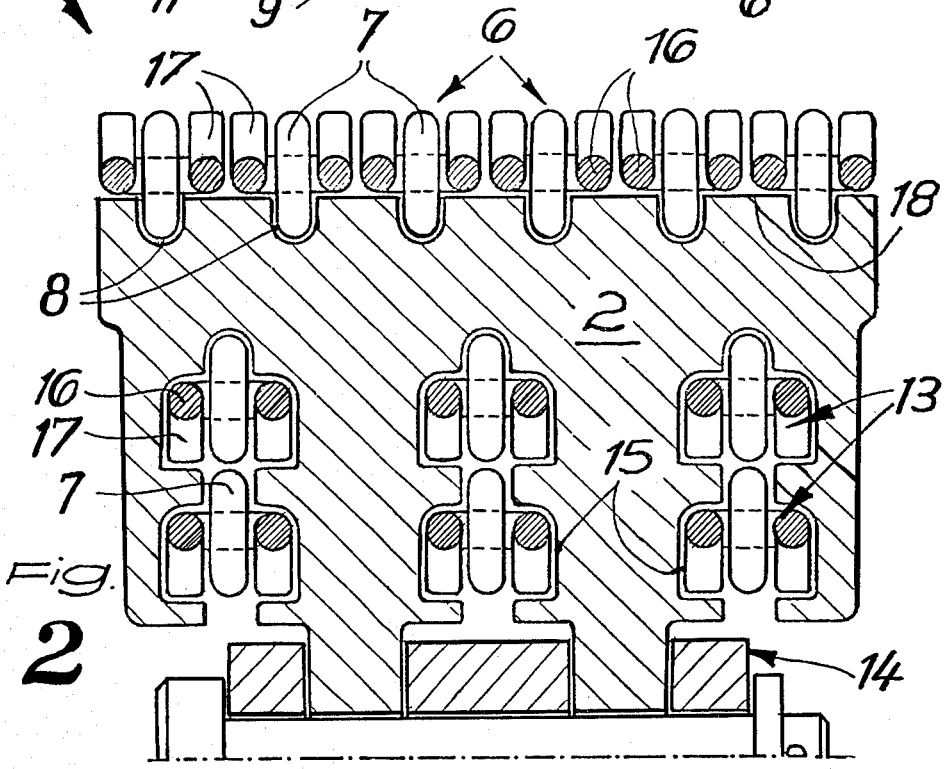
FIG. 2 is a partial vertical section through the ridge plate of the device shown in FIG. 1.

Referring to the drawing in particular, the invention embodied therein, comprises a progressive timbering device or shield support structure for use in excavations and mines which includes vertically spaced members in the form of a ridge plate 2 and a sill or footing 3 which are braced in a spaced apart position by a fluid pressure operated pressing cylinder and piston combination, generally designated 4.

The progressive timbering device as seen in the drawing comprises a moving cylinder 1, ridge plate 2, sill 3 and a fluid pressure operated pressing cylinder 4 arranged between the sill 3 and ridge plate 2. At least the ridge plate 2 is surrounded by an endless track or a chain mat 5 of endless chains 6 arranged side by side, of which at least the vertical links 7 are guided in guide recesses 8 on the ridge plate 2 in a longitudinal direction.

The sill 3 is advantageously surrounded by a chain mat 9 guided on it in a longitudinal direction. The endless chains 6 are always arranged close together side by side and thus form a closed chain mat 5. The ridge plate 2 and possibly the sill 3 have a run-up arch 10 and 11, respectively, on the coal face side. The run-up arch 10 is advantageously designed as a boom 12 pivotable up and down on the ridge plate 2 and it is preferably a component part of the ridge plate 2.

The chain strands 13 of mat 5 running back underneath the ridge plate 2 are guided in superposed arrangement past the press-on ram 14 or similar supporting members, e.g., they are engaged in guide channels 15 provided for that purpose.

The horizontal links 16 of the endless chains 6 forming the chain mat 5 have vertical engaging humps 17, between which the vertical links 7 are supported on their top side, while on their bottom side, the vertical links 7 are guided in slide grooves 8 in the ridge plate 2 designed as guide recesses and the horizontal links 16 rest on a slide face 18 of the ridge plate 2. The slide grooves 8 and slide faces 18 are designed as hardened or armored and thus wear-resistant surfaces. The slide grooves 8 and slide faces 18 may further have associated with them lubricant supply devices 19, for example, a grease brush, spray nozzle or the like.

While a specific embodiment of the invention has been shown and described in detail to illustrate the application of the principles of the invention, it will be understood that the invention may be embodied otherwise without departing from such principles.

What is claimed is:

1. A progressive timbering device, comprising a ridge plate, a sill disposed beneath said ridge plate, a fluid pressure operated pressing cylinder and piston combination disposed between said sill and said ridge plate, at least one of said sills and said ridge plates having an endless track guideway extending around the top and bottom and ends thereof, and an endless track engaged in said guideway and projecting outwardly of the associated one of said sills and said ridge plates, said endless track comprises an endless chain having vertical and horizontal links and including vertically extending engaging humps on said horizontal links between which the vertical links are supported and which project upwardly on the top reach of said chain and downwardly on the bottom reach of said chain, said associated ridge plate and sill having accommodating recesses for the vertical links on both the bottom and top surfaces thereof, the top surface of the associated ridge plate and sill having a hard slide surface over which the horizontal links move.

2. A progressive timbering device, according to claim 1, wherein said sill and said ridge plate have receiving grooves for accommodating the vertically disposed links of said chains and horizontal slide surfaces for supporting the horizontal links which comprises hardened surfaces.

3. A progressive timbering device, according to claim 2, including lubricant supply devices associated with said grooves accommodating the vertical links and faces on which said horizontal links slide.

4. A progressing timbering device having a moving cylinder, a ridge plate, at least one floor sill, and at least one pressure cylinder connected between the floor sill and the ridge plate, characterized in that at least the ridge plate is surrounded by an endless chain mat comprising closely juxtaposed endless chain having vertical links, at least the vertical links of said chain being guided in a forward direction in guide recesses on the ridge plate.

5. A progresssive timbering device comprising a ridge plate, a sill disposed beneath said ridge plate, a fluid pressure-operated pressing cylinder and piston combination disposed between said sill and said ridge plate, at least one of said sills and said ridge plates having an endless track guideway extending around the top and bottom and ends thereof, and an endless track engaged in said guideway and projecting outwardly of the associated one of said sills and said ridge plates, said endless track comprising a chain mat made up of a plurality of closely juxtaposed endless chains having vertical and horizontal links, said associated ridge plate and sill having accommodating recesses for said vertical links.

6. A progressive timbering device, according to claim 5, wherein said ridge plate includes said guideway and said track.

7. A progressive timbering device, according to claim 5, wherein each of said ridge plates and said sills includes an endless track guideway with an endless track therein.

8. A progressive timbering device, according to claim 5, wherein at least one of said sills and said ridge plates includes a run-up arch portion on an end thereof facing the coal face.

9. A progressive timbering device, according to claim 5, wherein at least one of said ridge plates and said sills includes a main portion and a run-up arch portion pivotally connected to said main portion and comprising a boom.

10. A progressive timbering device, according to claim 5, including a pressing ram articulated between said ridge plate and said sill, a moving plate connected to said sill for advancing it into the excavation, said pressing ram having an access for the passage of the endless track between said pressing ram and the associated ridge plate.

* * * * *